US007469745B2

(12) United States Patent
Smith et al.

(10) Patent No.: US 7,469,745 B2
(45) Date of Patent: Dec. 30, 2008

(54) APPARATUS AND METHOD TO MECHANICALLY ORIENT PERFORATING SYSTEMS IN A WELL

(75) Inventors: David Randolph Smith, College Station, TX (US); Gary O. Harkins, Bakersfield, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/470,215

(22) PCT Filed: Jan. 30, 2002

(86) PCT No.: PCT/US02/02735

§ 371 (c)(1),
(2), (4) Date: Mar. 17, 2004

(87) PCT Pub. No.: WO02/061235

PCT Pub. Date: Aug. 8, 2002

(65) Prior Publication Data

US 2004/0144539 A1 Jul. 29, 2004

(51) Int. Cl.
*E21B 47/024* (2006.01)

(52) U.S. Cl. ..... 166/255.2; 166/297; 166/55.1; 175/4.51

(58) Field of Classification Search ..... 166/255.2, 166/255.1, 55.1, 297, 291; 175/4.51
See application file for complete search history.

(56) References Cited

U.S. PATENT DOCUMENTS

| | | | | |
|---|---|---|---|---|
| 2,347,769 | A * | 5/1944 | Crites | 166/53 |
| 2,621,384 | A * | 12/1952 | Slaughter | 248/137 |
| 3,011,550 | A * | 12/1961 | Kenneday | 175/4.51 |
| 3,012,608 | A * | 12/1961 | McLaren, Jr. | 175/4.51 |
| 3,031,965 | A * | 5/1962 | Nelson | 175/4.51 |
| 3,175,608 | A * | 3/1965 | Wilson | 175/4.51 |
| 3,175,617 | A * | 3/1965 | North | 175/4.51 |
| 3,426,849 | A * | 2/1969 | Brumble, Jr. | 166/255.2 |
| 3,465,836 | A * | 9/1969 | Fields | 175/4.51 |
| 3,656,562 | A * | 4/1972 | Baugh | 175/4.51 |
| 3,730,282 | A | 5/1973 | Chapman | |
| 3,830,303 | A * | 8/1974 | Perkins | 166/297 |
| 3,844,345 | A * | 10/1974 | Evans et al. | 166/72 |

* cited by examiner

*Primary Examiner*—Giovanna C Wright
(74) *Attorney, Agent, or Firm*—Kevin B. McGoff; Robert A. VanSomeren; James L. Kurka

(57) ABSTRACT

The present invention relates to an apparatus and method for using that apparatus to orient a perforating gun or system to minimize or eliminate the damage which may be caused to exterior control conduits, conductors or devices, or to adjacent interior well control lines, conduits or tubing by attaching the perforating system to a device which has a resilient cam or guide which engages a slot formed on the interior of a specially fabricated tubular member attached at a spaced distance from the perforating systems blast and which is so oriented as to permit the attachment of the lines or conduits or devices in the opposite radial direction from the blast of the perforating system.

27 Claims, 3 Drawing Sheets

APPARATUS AND METHOD TO MECHANICALLY ORIENT PERFORATING SYSTEMS IN A WELL

BACKGROUND OF THE INVENTION

1. Field of Invention

This invention presents an apparatus and method to mechanically orient perforating systems in a well relative to other devices, conduits, wave-guides, and electrical cable disposed in a well.

2. State of the Art

Typically to extract fluids from below the earth's surface, a casing is run into a penetration made in the earth, referred to herein as a well bore, and a length of casing is disposed concentrically inside the well bore. This casing is grouted into the well by placing a cement grout in the annular space between the casing outer surface and the well bore forming a bond between the casing's outer diameter and the well bore. Production tubing or drill pipe may also be deployed within the casing. Subsequently the casing (or tubing or pipe, if applicable), the cement, and at least one subterranean formation are penetrated by the use of a variety of perforating systems known to those familiar with oil and gas production, typically consisting of explosive charges disposed inside a tubular housing connected to a surface detonation device by an electrical conductor. The perforating systems when actuated form high-pressure exhaust jets and their resulting shock waves penetrate the casing (or tubing or pipe, if applicable), cement and subterranean formation. Other types of perforating systems utilize high pressure fluids and or abrasives to cut through the casing (or tubing or pipe, if applicable), the cement, and the formation to create the required perforation or slot, and thereby allow communication of subterranean fluids into the casing, pipe, or tubing being perforated. In any case (the explosive charge method, or the hydraulic penetration or other penetration methods), the objective is to allow for a pressure or hydraulic communication path to be formed from the inner diameter of the casing, pipe, or tubing into the subterranean formation and each is collectively referred to herein as a perforating gun.

In certain cases, the casing, pipe, or tubing to be penetrated is positioned in the well adjacent other devices or conduits which may be disposed parallel to the outer diameter of the casing, pipe, or tubing at the depth to be penetrated. When perforating the casing, pipe, or tubing in these situations, the resulting penetration operation may also inadvertently penetrate or otherwise damage the adjacent device or conduit. Hence, in the situation involving any parallel conduits or devices disposed in well at the depth where the penetration is to be made as in some dual string completion systems, or when other devices are located outside the casing, pipe, or tubing to be perforated at the same depth, it is possible to inadvertently penetrate these other conduits or devices. These devices and conduits can be control lines, dual production tubing, casing strings, pressure gauge carriers, geophones, hydrophones, wave guides, sensing devices, and many other tools and instruments disposed in subterranean environments.

The device and method described herein aligns the perforating systems such that, when they are energized, they penetrate a predetermined radial direction relative to this inventions apparatus, and by fixing other devices and conduits in a position that is known relative to the apparatus of this invention a method is presented to avoid damaging or penetrating devices and conduits upon perforation. An orientation method and apparatus disclosed also accomodates perforating systems to purposely penetrate, ignite, or excite devices and apparatus connected to the casing or tubing in which the perforating system is disposed concentrically inside, such that the device, explosive charge, or conduit connected to the pipe is disposed in a known radial position relative to this inventions orientation device.

DETAILED DESCRIPTION OF A PREFERRED EMBODIMENT

Figure 1:
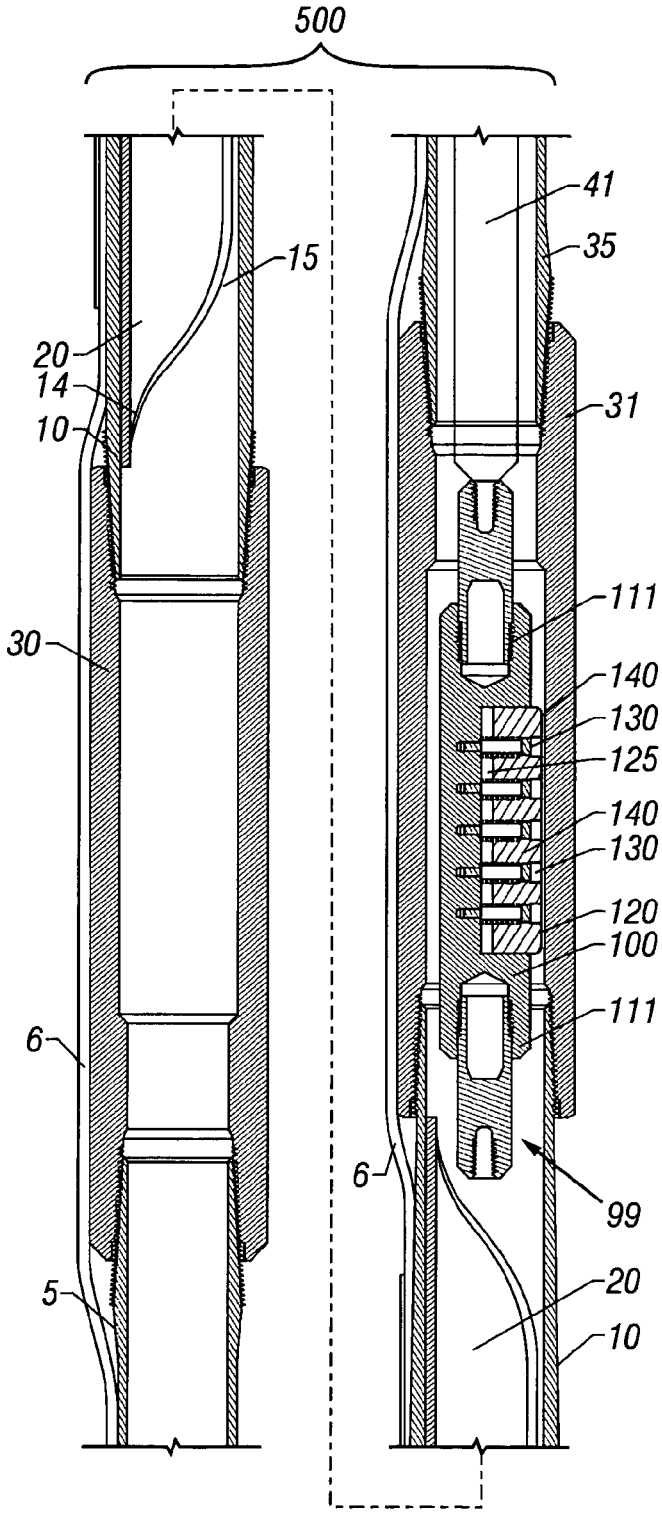
FIG. 1 is a cross-sectional view of the apparatus and orienting guide in a casing.

FIG. 1 of the present invention is a cross sectional view of the apparatus in the guiding profile section of the tubular member. Tubulars 5 and 35 are connected in the well bore to couplings 30 and 31 in a manner well known in the industry. Couplings 30 and 31 join a specially fabricated tubular 10 that provides an inner raceway orienting surface 14. A cooperating profile of the tubular 10 is formed by the insertion of the raceway orienting surface 14, which forms a tang at each end of the longitudinal passage of the tubular 10 which gradually slopes around the periphery to fill the tubular 10 except for an orienting channel 15 formed on the interior of 10 by the proximate adjacent longitudinal walls of the member 20. Member 20 may comprise a sleeve with the appropriate shape incorporating orienting surface 14 and orienting channel 15. Other methods of fabricating the tubular 10 with a cooperating groove 15 can be readily substituted without departing from the disclosure. For example, the tubular 10 could be milled with a grooved surface in a manner well known to those in this art. Likewise, a resilient grooved mechanism could be formed on the orienting mandrel and a ridge formed on the interior surface of the orienting tubular to be used in the same manner and with the same result. It is noted that tubular 10 may include an orienting surface 14 on each of its ends so as to facilitate orientation of devices moving in the downhole direction as well as devices moving in the uphole direction.

Figure 4:
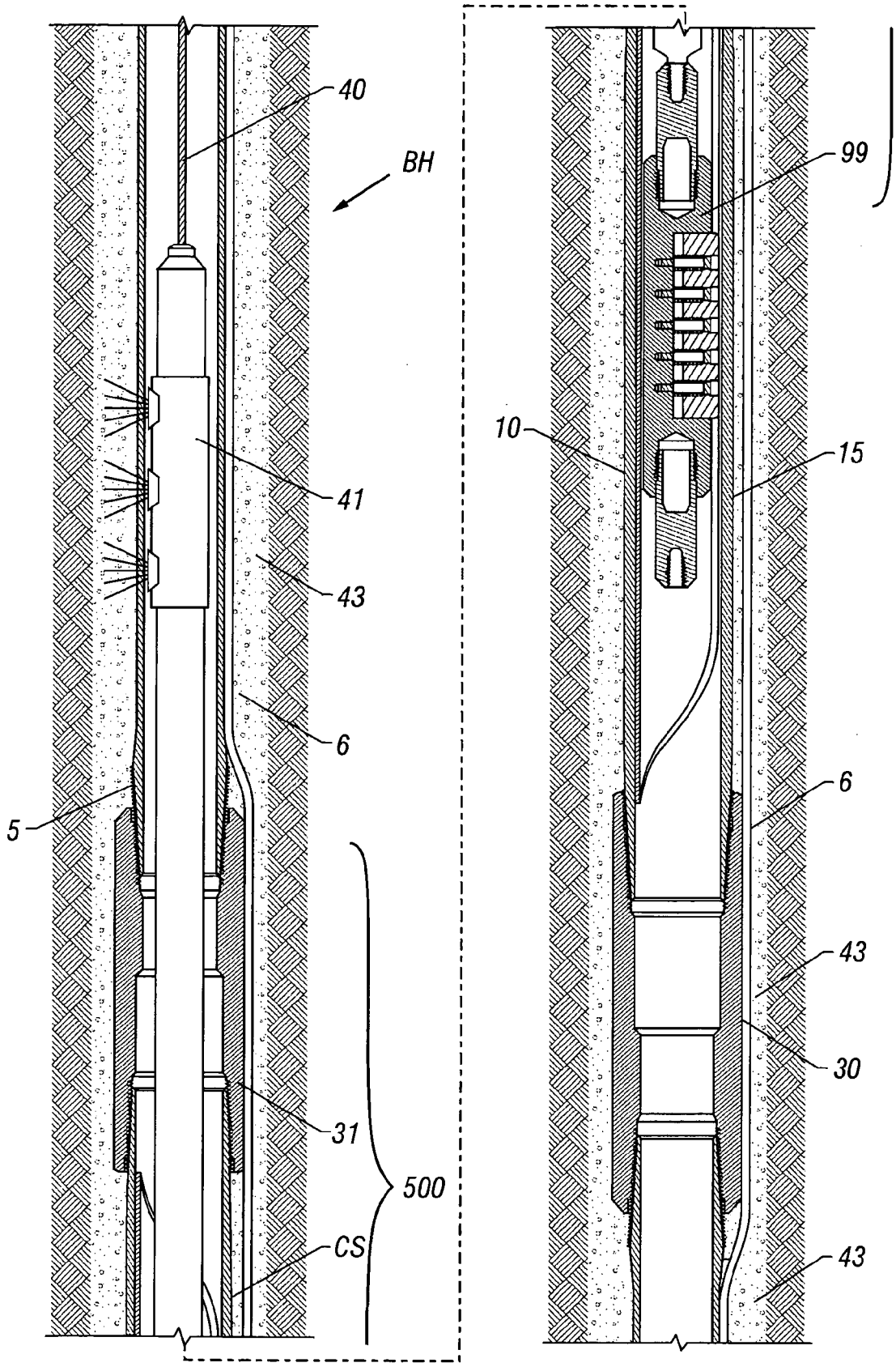
FIG. 4 is a schematic representation of the apparatus in a well bore orienting the perforating tool away from the conduits or conductors on the opposite side of the tubular body.

Tubular 10 along with tubulars 5 and 35 and other similar tubulars comprise a tubular well string 500 which can be a casing string (to be cemented within a wellbore as shown in FIG. 4), a drill pipe string, a production or completion string, or other similar types of strings disposed in wellbores.

An orienting mandrel 99 cooperates with the tubular 10. The orienting mandrel 99 consists of a cylindrical body 100 formed with a longitudinal slot 125 and is configured at each end 111 to be connected to a perforating gun 41 and/or a conveyance device 40. The conveyance device 40 can comprise any of the known methods of conveyance, including wireline (see FIG. 4), slickline, coiled tubing, tubing string, or drill pipe, among others.

An orienting guide or cam 120 is fashioned to slidably fit inside the slot 125 of the cylindrical body 100 and is retained therein by cap head screws 130. Springs or other resilient members 140 are positioned between the orienting guide 120 and the interior surface of the slot 125 on the body 100 to urge the orienting guide or cam 120 into engagement with orienting surface 14 and slot 15 formed on the inside surface of tubular 10. Tubular 10 is placed or coupled or set in the tubular string 500 by couplings 30 and 31 at the location desired, so that the orienting guide is a known distance from the zone to be perforated. The provision of the orienting guide in a spaced relationship with the perforating system permits the perforation to proceed with the greatest amount of protection for the adjacent conduit or device. Although the orienting mandrel 99 and perforating gun 41 are shown in the Figures to be separate connected pieces, it is understood that the mandrel 99 (and guide 120) can be integral with the perforating gun body. In addition, the perforating gun 41 can be located above or below the orienting mandrel 99 and guide 120. Moreover, each perforating gun 41 or mandrel 99 can have more than one guide 120.

The conduit or device, hereinafter referred to as "protected member" 6, which is to be protected from the blast of the perforating gun is aligned on the string 500 and attached in a manner well known to those in the art so that it runs opposite the slotted interior 15 and therefore opposite the radial direction of the perforating gun. Although shown in the Figures as a control or fiber optic line, protected member 6 can comprise any of a number of conduits or devices, including electrical cables, fibre optic cables, fluid conduits, gauge carriers, geophones, hydrophones, wave guides, sensors, other tubing, valves as well as other instruments know to those familiar with the art which are from time to time disposed in a well. This configuration of the slot 15, the downhole member 6 and the positioning of the perforating gun may be altered, so long as it is done consistently, without departing from the spirit of this disclosure.

Figure 2:
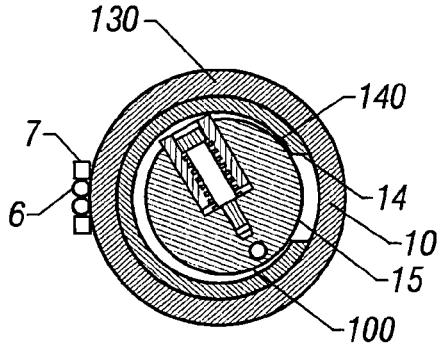
FIG. 2 is a cross-sectional view of the device before movement into the preferred orientation.

FIG. 2 shows the orienting assembly after it has entered the tubular 10, but before it has been turned by cooperating surface 14 to seat in the groove 15 on the interior surface of the tubular 10. Protected member 6 is positioned and attached, such as by one or more clamps or tabs 7 placed on the exterior surface of tubular 10, before insertion of the tubular 10 in the wellbore. In another embodiment, the protected member 6 is attached to the interior surface of the tubular 10.

Figure 3:
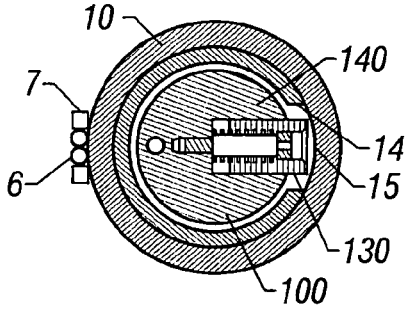
FIG. 3 is a cross-sectional view of the device after movement into the preferred orientation.

FIG. 3 shows the orienting assembly after it has been turned by the cooperating surface 14 so that the orienting guide 120 follows slot 15. Due to their relative attachment, the perforating gun 41 turns along with the orienting mandrel 99. This then results in the guns being oriented and perforating in a predetermined radial direction relative to and away from the protected member 6 (see FIG. 4). It is understood that a swivel may be located above the perforating gun in order to allow the joint rotation of the perforating gun and orienting mandrel 99 and guide 120 in relation to the conveyance device 40.

In one embodiment, the internal diameter of the string 500 above and below the orienting surface 14 is larger than the internal diameter of the remainder of the well string 500. The section of larger internal diameter, which on each end of orienting surface 14 can be approximately 1 foot long, functions to ensure that the orienting guide 120 "catches" and is turned by cooperating surface 14 and follows slot 15.

FIG. 1 shows the well string 500 (including tubular 10) within a casing string CS in a wellbore. In this embodiment wherein well string 500 does not comprise the casing string CS, the protected member 6 (shown to be a control or fiber optic line) is disposed in the annulus between the casing string CS and the well string 500. Once the orienting guide 120 engages the orienting tubular 10, the perforating gun 41 would be oriented away from protected member 6 as described below and shown with respect to FIG. 4.

FIG. 4 shows the embodiment wherein the well string 500 comprises the casing string CS. In this embodiment, the well string 500 is grouted or cemented in the annulus 43 of a borehole BH. The perforating gun 41 and orienting mandrel 99 are lowered within the well string 500 by a conveyance device 40. As previously disclosed, the orienting guide 120 engages the orienting tubular 10 to rotate the perforating gun 41 and orienting mandrel 99. As may be readily appreciated, the protected member 6 has been attached to the exterior surface of the tubular member 10 adjacent the interior slot 15 and the perforating gun 41 is oriented to fire away from the protected member 6.

Figure 5:
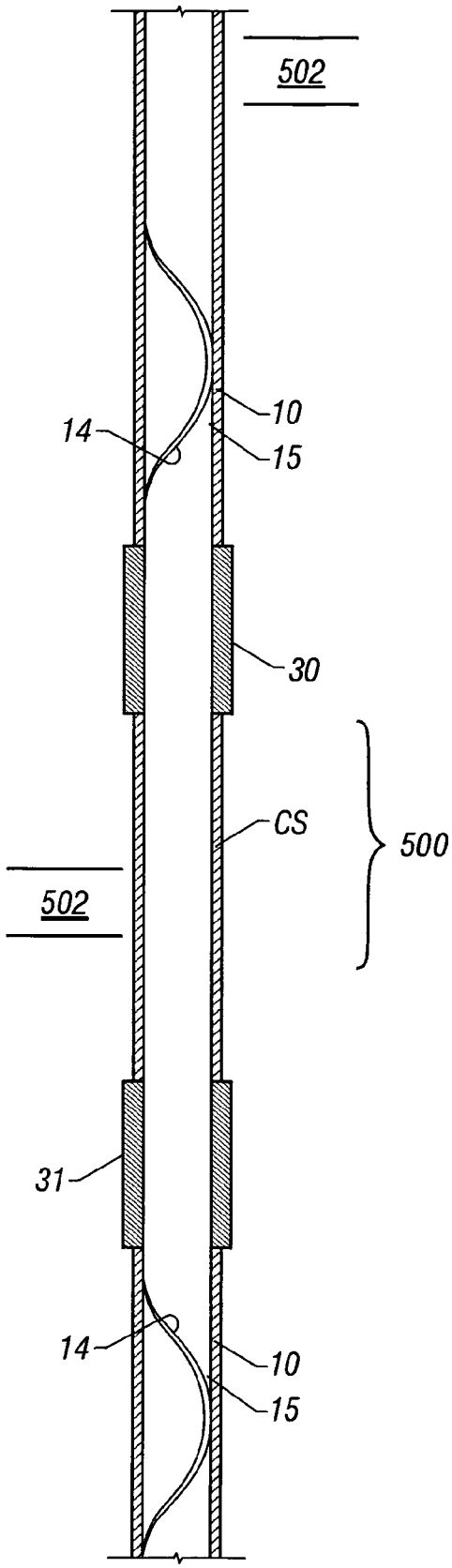
FIG. 5 is a schematic representation of the apparatus including multiple orienting tubulars 10 in the same wellbore.

In one embodiment as shown in FIG. 5, multiple orienting tubulars 10 may be included in the same well string 500. Each tubular 10 may correspond to a particular zone or region 502. An operator may perforate a zone or region 502 per run by running the perforating gun 41 and mandrel 99 to depth (using depth correlation) wherein the mandrel 99 engages the relevant tubular 10. Engagement between the mandrel 99 and tubular 10 as previously disclosed ensures that the protected member 6 is not damaged during perforation. Subsequent runs would have the mandrel 99 engage a different tubular 10 in order to perforate a different zone or region 502, also without damaging protected member 6. The spacing between the tubulars 10 may be varied or regular.

In another embodiment, well string 500 may include multiple orienting tubulars 10 and a plurality of perforating guns and guide mandrels may be deployed at one time. In this embodiment, the elements are spaced out so that each guide mandrel cooperatively engages (as previously disclosed) its relevant tubular 10 at the same time. Thus, each of the perforating guns is properly oriented so as to not damage protected member 6. This embodiment may necessitate the use of swivels between each perforating gun to allow the independent orientation of each perforating gun.

This apparatus relates to the method and apparatus to orient perforating systems disposed in a well string in such a manner as to avoid penetrating other protected members disposed in said wells by placing and fixing a mechanical orienting device to the well string to be perforated in the well. This apparatus places a device integral in the well string to be perforated, which forces the perforating system, which is disposed concentrically inside the well string to be penetrated to rotate to a predetermined direction relative to this device connected to the well string to be perforated. The method disclosed for using this apparatus also connects other protected members to the well string to be penetrated by the perforating system, such that they are fixed to the well string to be penetrated and hence are located in a predetermined radial position relative to the well string to be penetrated.

In use, at least one protected member is attached to the well string to be perforated, opposite to the orientation of the perforating gun. This disclosure further teaches the placement of an orienting guide attached to a perforating system to couple or guide the perforating system into the orientation device previously disposed in the well string to be perforated. When the perforating device and the orienting guide attached to the perforating device encounter the predisposed orientation device, the perforating gun system rotates to the predetermined radial position relative to the perforating device. This disclosure then teaches the energizing of the perforating system while the orienting guide is engaged in the orientation device.

It will be understood that the foregoing description is of preferred exemplary embodiments of this invention, and that the invention is not limited to the specific forms shown. These and other modifications may be made in the design and arrangement of the elements without departing from the scope of the invention as expressed in the appended claims.

We claim:

1. A well casing system useful for mechanically orienting a perforating system comprising a guide member oriented in a fixed radial relationship with respect to a perforator gun, comprising:

an orienting tubular positioned in a casing string cemented in a wellbore;

a protected member disposed along the casing string;

a guide receiving member on an interior surface of the orienting tubular, the guide receiving member oriented in a fixed radial relationship with respect to the protected member;

a cam mounted in the guide member, the cam being movable in a radial direction; and wherein the guide receiving member cooperates with the cam to orient the perforator gun away from the protected member, further wherein a section of the casing string above and below the guide receiving member has an internal diameter larger than the internal diameter of the remainder of the casing string.

2. The well casing system of claim 1 wherein the orienting tubular is one of the segments of the casing string.

3. The well casing system of claim 1 further comprising a mechanism for attaching the protected member to the casing string.

4. The well casing system of claim 1 wherein the protected member is attached to an exterior surface of the string.

5. The well casing system of claim 1 wherein the guide receiving member comprises a slotted guide path.

6. The well casing system of claim 5 wherein the slotted guide path is formed by a sleeve fixed in the orienting tubular comprising tangs at opposite longitudinal ends and opposing peripheral surfaces sloping from the tangs to opposite ends of a channel defined between the opposing peripheral surfaces.

7. The well casing system of claim 1 wherein the guide receiving member comprises an orienting surface.

8. The well casing system of claim 1, wherein the guide receiving member comprises an orienting surface on its uphole end and an orienting surface on its downhole end.

9. The well casing system of claim 1 wherein the protected member comprises a fiber optic cable, an electrical cable, a hydraulic line or a combination thereof.

10. A perforating system useful for perforating a well casing system having a protected member secured to a casing string including spaced orienting tubulars having a guide receiving member on an interior surface thereof for orienting the perforation system to perforate away from the protected member, comprising:

a perforator gun attached to a conveyance device for passing the perforator gun through the casing string to a predetermined depth;

a guide mandrel secured to the perforator gun in fixed radial relationship therewith, the guide mandrel also being axially spaced from the perforator gun, wherein the guide mandrel comprises opposed connection ends that enable connection of the perforator gun above or below the guide mandrel; and a guide member fixed on an exterior surface of the guide mandrel passable through the orienting tubulars in cooperation with the guide receiving members to orient the perforator gun to perforate away from the protected member.

11. The perforating system of claim 10 wherein the guide member comprises a cam.

12. The perforating system of claim 11 wherein the cam is resiliently outwardly biased linearly in a radial direction.

13. The perforating system of claim 11 wherein the guide member comprises a plurality of cams.

14. The perforating system of claim 10 wherein the guide receiving members comprise a slotted guide path and the guide member comprises a cam passable through the slotted guide paths.

15. The perforating system of claim 14 wherein the slotted guide paths are formed by a sleeve fixed in the orienting tubular comprising tangs at opposite longitudinal ends and opposing peripheral surfaces sloping from the tangs to opposite ends of a channel defined between the opposing peripheral surfaces.

16. The perforating system of claim 14 wherein the cam is resiliently outwardly biased.

17. The perforating system of claim 16 wherein the guide member comprises a plurality of cams.

18. The perforating system of claim 10 wherein the protected member comprises a fiber optic cable, an electrical cable, a hydraulic line or a combination thereof.

19. A method for casing a well, comprising:

connecting casing joints together end-to-end to form a casing string;

inserting an orienting tubular in the casing string;

wherein a guide receiving member is fixed on an interior surface of the orienting tubular;

securing a protected member along the casing string in a radially oriented position with respect to the guide receiving member;

cementing the string in a well bore;

suspending a perforator gun attached to a conveyance device, a guide mandrel secured to the perforator gun in fixed radial relationship therewith and a guide member fixed to the guide mandrel;

passing the perforator gun through the casing string to a depth below a surface of the well;

radially orienting the perforator gun with respect to the protected member by interengagement of the guide member with the guide receiving member as the perforator gun is passed through the orienting tubular;

activating the perforator gun to perforate the casing string away from the protected member; and deploying a second orienting tubular in the casing string at a distance from the orienting tubular.

20. The method of claim 19 further comprising spacing additional orienting tubulars along the casing string.

21. The method of claim 19 further comprising attaching the protected member on an exterior surface of the casing string.

22. The method of claim 19 wherein a section of the string above and below the guide receiving member has an internal diameter larger than the internal diameter of the remainder of the string.

23. The method of claim 19 wherein the guide receiving member comprises a slotted guide path and the guide member comprises a cam passable through the slotted guide paths.

24. The method of claim 23 wherein the slotted guide path is formed by a sleeve fixed in the orienting tubular comprising tangs at opposite longitudinal ends and opposing peripheral surfaces sloping from the tangs to opposite ends of a channel defined between the opposing peripheral surfaces.

25. The method of claim 23 wherein the cam is resiliently outwardly biased.

26. The method of claim 25 wherein the guide member comprises a plurality of cams.

27. The method of claim 19, wherein the protected member comprises a fiber optic cable, an electrical cable, a hydraulic line or a combination thereof.

* * * * *